US006650093B1

(12) United States Patent
Baldwin et al.

(10) Patent No.: US 6,650,093 B1
(45) Date of Patent: Nov. 18, 2003

(54) AUXILIARY BOUNDARY REGULATOR THAT PROVIDES ENHANCED TRANSIENT RESPONSE

(75) Inventors: Dave Baldwin, Allen, TX (US); Sanmukh Patel, Richardson, TX (US); Ross E. Teggatz, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/162,113

(22) Filed: Jun. 3, 2002

(51) Int. Cl.[7] ..... G05F 1/613
(52) U.S. Cl. ..... 323/224; 323/280; 323/281
(58) Field of Search ..... 323/224, 281, 323/273, 280, 274

(56) References Cited

U.S. PATENT DOCUMENTS 5,608,312 A * 3/1997 Wallace ..... 323/224
5,864,227 A * 1/1999 Borden et al. ..... 323/280
5,966,004 A * 10/1999 Kadanka ..... 323/271
6,201,375 B1 * 3/2001 Larson et al. ..... 323/277
6,333,623 B1 * 12/2001 Heisley et al. ..... 323/280
6,377,033 B2 * 4/2002 Hsu ..... 323/274

* cited by examiner

*Primary Examiner*—Shawn Riley
(74) *Attorney, Agent, or Firm*—Alan K. Stewart; W. James Brady, III; Frederick J. Telecky, Jr.

(57) ABSTRACT

The regulator circuit with an auxiliary boundary regulator that provides enhanced transient response includes: an upper comparator 24 having a first input coupled to a feedback node and a second input coupled to a first reference voltage node V_HIGH; a lower comparator 26 having a first input coupled to the feedback node and a second input coupled to a second reference voltage node V_LOW; a first switching device 30 having a control node coupled to an output of the upper comparator 24; a second switching device 28 having a control node coupled to an output of the lower comparator 26; an inductor 36 having a first end coupled to the first and second switching devices 28 and 30, and a second end coupled to an output node Vout; and a feedback circuit 32 and 34 coupled between the output node Vout and the feedback node. This circuit provides a precise, quiet, linear regulator that provides a tightly regulated output with a fast regulator working in parallel to ensure that the output voltage stays within an acceptable boundary.

11 Claims, 1 Drawing Sheet

AUXILIARY BOUNDARY REGULATOR THAT PROVIDES ENHANCED TRANSIENT RESPONSE

FIELD OF THE INVENTION

This invention generally relates to electronic systems and in particular it relates to an auxiliary boundary regulator that provides enhanced transient response.

BACKGROUND OF THE INVENTION

There are a number of ways to accomplish a voltage regulation function, but two are more commonly used: (1) a continuous-time analog regulator or switched mode power supply (SMPS) with a continuous-time control loop, and (2) a 'hysteretic' type of converter which simply responds to provide energy when the regulated output falls outside of a hysteretic window. The first type provides a tightly controlled, lowripple, output voltage, and in the case of the SMPS, a controlled operating frequency, but the transient response time is slow. A fast load or supply transient can send the output out of regulation limits before the control loop can respond. The second type has a large ripple voltage and uncontrolled frequency, but the response time is extremely fast.

One prior art device involves the use of a linear regulator to perform the boundary function about an SMPS main converter. Another prior art device involves using a similar fast recovery converter around the main converter, which is an SMPS.

SUMMARY OF THE INVENTION

A regulator circuit with an auxiliary boundary regulator that provides enhanced transient response includes: an upper comparator having a first input coupled to a feedback node and a second input coupled to a first reference voltage node; a lower comparator having a first input coupled to the feedback node and a second input coupled to a second reference voltage node; a first switching device having a control node coupled to an output of the upper comparator; a second switching device having a control node coupled to an output of the lower comparator; an inductor having a first end coupled to the first and second switching devices, and a second end coupled to an output node; and a feedback circuit coupled between the output node and the feedback node. This circuit provides a precise, quiet, linear regulator that provides a tightly regulated output with a fast regulator working in parallel to ensure that the output voltage stays within an acceptable boundary.

DESCRIPTION OF PREFERRED EMBODIMENTS

Figure 1:
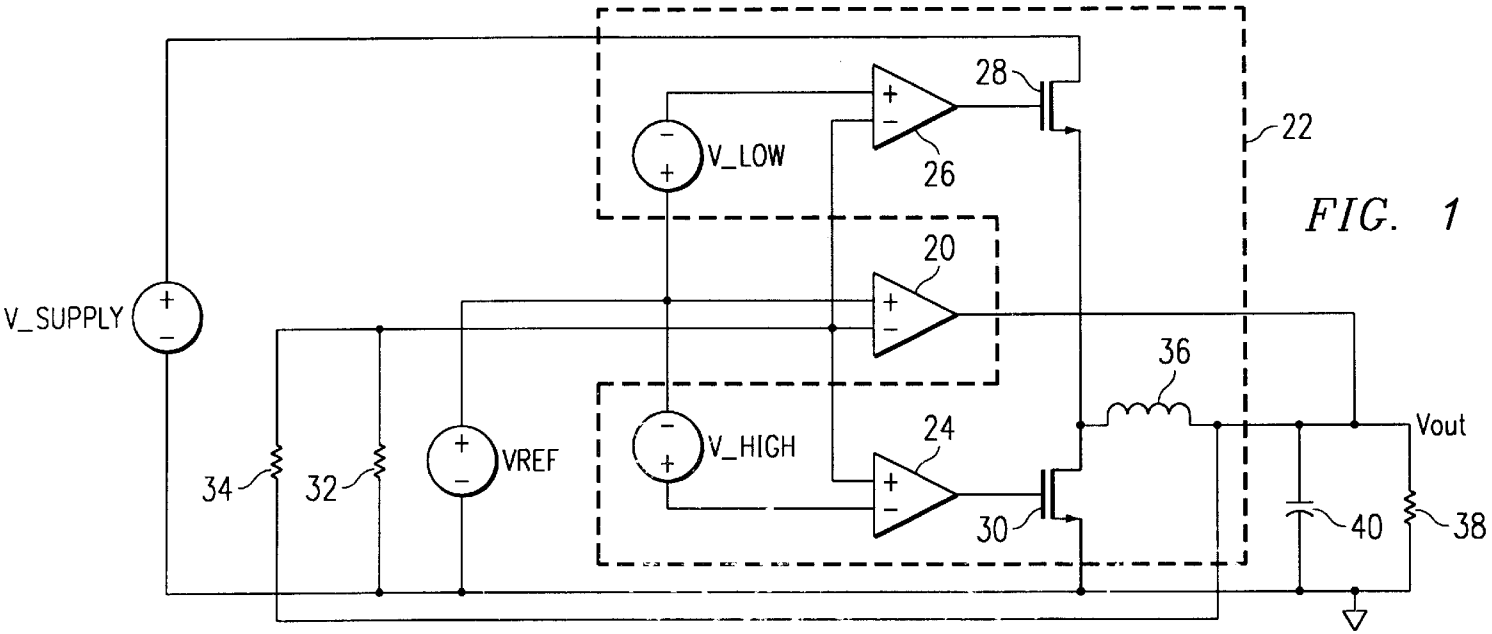
FIG. 1 is a schematic circuit diagram of a preferred embodiment device with an auxiliary boundary regulator that provides enhanced transient response.

The preferred embodiment device shown in FIG. 1 provides a precise, quiet, linear regulator to provide a tightly regulated output, but with a fast regulator working in parallel to ensure that the output voltage stays within an acceptable boundary. The device also integrates the boundary regulation function with the main continuous time function, using the same switching MOSFETs for both functions. In this way, the fast response of the boundary regulation is added without the expense of an extra pair of MOSFETs or an extra inductor.

The preferred embodiment device of FIG. 1 includes: main regulator 20; boundary regulatory 22 that includes upper comparator 24, lower comparator 26, transistors 28 and 30, lower threshold voltage source V—LOW, and upper threshold voltage source V—HIGH; feedback resistors 32 and 34; inductor 36; load resistance 38; capacitor 40; output voltage Vout; supply voltage V—SUPPLY; and reference voltage VREF.

Figure 2:
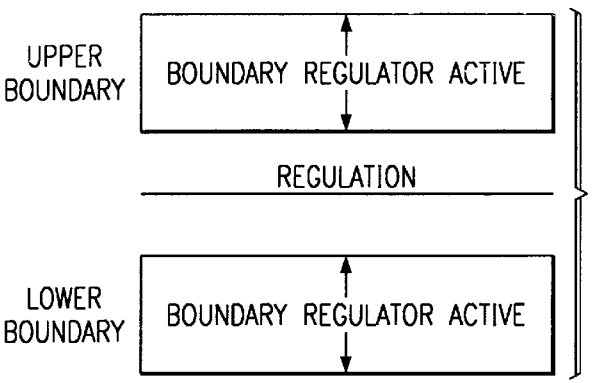
FIG. 2 is a diagram describing the operation of the circuit of FIG. 1.

In the diagram shown in FIG. 2, the main regulator 20 provides a regulation point shown by the line labeled "Regulation". The boundary regulator 22 simply consists of a pair of comparators 24 and 26 with thresholds V—LOW and V—HIGH set at some voltage above "Upper Boundary" and below, "Lower Boundary", the regulation point.

The boundary regulator 22 remains off unless a transient presents itself of a magnitude sufficient to displace the output voltage Vout from the regulation line into the Boundary Regulator Active areas. Once the output Vout exceeds the upper or lower boundaries, the boundary regulator 22 will activate and provide counteractive energy until such time as the output voltage Vout returns to a point within the two boundary limits.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A regulator circuit comprising:

an upper comparator having a first input coupled to a feedback node and a second input coupled to a first reference voltage node;

a lower comparator having a first input coupled to the feedback node and a second input coupled to a second reference voltage node;

a first switching device having a control node coupled to an output of the upper comparator;

a second switching device having a control node coupled to an output of the lower comparator;

an inductor having a first end coupled to the first and second switching devices and a second end coupled to an output node;

a feedback circuit coupled between the output node and the feedback node; and a main regulator having a first input coupled to a main reference voltage node, a second input coupled to the feedback node, and an output coupled to the output node.

2. The circuit of claim 1 wherein the feedback circuit comprises:

a first resistor coupled between the output node and the feedback node; and a second resistor coupled between the output node and a common node.

3. The circuit of claim 1 wherein the first and second switching devices are transistors.

4. The circuit of claim 1 wherein the first and second switching devices are MOSFETs.

5. The circuit of claim 1 further comprising;

a first reference voltage source coupled between the first reference voltage node and the main reference voltage node; and a second reference voltage source coupled between the second reference voltage node and the main reference voltage node.

6. A voltage regulator circuit comprising:

a main regulator having a first input coupled to a reference voltage node, a second input coupled to a feedback node, and an output coupled to an output node;

an upper comparator having an input coupled to the feedback node;

a lower comparator having an input coupled to the feedback node;

a first switching device having a control node coupled to an output of the upper comparator;

a second switching device having a control node coupled to an output of the lower comparator;

an inductor having a first end coupled to the first and second switching devices and a second end coupled to the output node; and a feedback circuit coupled between the output node and the feedback node.

7. The circuit of claim 6 further comprising;

a first threshold voltage source coupled to the upper comparator; and a second threshold voltage source coupled to the lower comparator.

8. The circuit of claim 6 wherein the first switching device is coupled between the inductor and a positive power supply node, and the second switching device is coupled between the inductor and a negative power supply node.

9. The circuit of claim 6 wherein the feedback circuit comprises:

a first resistor coupled between the output node and the feedback node; and a second resistor coupled between the output node and a common node.

10. The circuit of claim 6 wherein the first and second switching devices are transistors.

11. The circuit of claim 6 wherein the first and second switching devices are MOSFETs.

* * * * *